US005924140A

United States Patent [19]

Chi

[11] Patent Number: 5,924,140

[45] Date of Patent: Jul. 20, 1999

[54] KNEE/ELBOW CAP

[76] Inventor: Cheng-Hsian Chi, No. 15, Lane 22, Tung Hsing E.Str., Taichung, Taiwan

[21] Appl. No.: 09/135,152

[22] Filed: Aug. 17, 1998

[51] Int. Cl.[6] ..... A41D 13/00

[52] U.S. Cl. ..... 2/455; 2/16; 2/24; 2/911

[58] Field of Search ..... 2/16, 22, 911, 2/919, 455

[56] References Cited

U.S. PATENT DOCUMENTS

| | | | |
|---|---|---|---|
| 4,796,303 | 1/1989 | Atwater | 2/24 |
| 5,560,041 | 10/1996 | Walker | 2/24 |
| 5,594,954 | 1/1997 | Huang | 2/24 |
| 5,687,422 | 11/1997 | Wurst et al. | 2/24 |
| 5,711,029 | 1/1998 | Visco et al. | 2/24 |
| 5,727,252 | 3/1998 | Oetting et al. | 2/24 |

*Primary Examiner*—Diana L. Oleksa
*Assistant Examiner*—Katherin Moran
*Attorney, Agent, or Firm*—Connolly & Hutz

[57] ABSTRACT

A knee/elbow cap, comprising:

a cushion pad integrally made of injected plastics and having an curved upper layer, a curved lower layer, and a plurality of rib plates;

a sponge layer adhering to said lower layer;

an unwoven cloth layer adhering to said sponge layer; and two elastic bands fixing to said cap, each of said two bands having a Velcro latch attached at an end; wherein said plurality of rib plates extend from the upper layer to the lower layer in a form of crossing and connecting with one another and divide a space between the upper layer and the lower layer into a plurality of small rooms to make the cushion pad have a grid like structure.

4 Claims, 4 Drawing Sheets

KNEE/ELBOW CAP

BACKGROUND OF THE INVENTION

1. Field of the Invention

The present invention relates to a knee/elbow cap, particularly to a knee/elbow cap, having a better strength and shock absorption.

2. Description of Related Art

A knee/elbow cap is a kind of sport facility for protecting a knee or an elbow from hurt resulting from collisions while an exerted sport such as skating, gliding and etc. is conducted. It is quite important for a knee/elbow cap to have a high strength and strong shock absorption against collisions. In addition, it is desirable for a knee/elbow cap to have an attractive appearance. A prior art knee/elbow cap provides a cushion pad. The cushion pad has several elongated orderly guard bars and grooves thereon and has a protective bowl projecting outward in the middle part thereof. But, the prior art knee/elbow cap has not only a sophisticate structure but also an unfavorable strength and shock absorption. Furthermore, a variety of designs are hard to be made on the protective bowl to form an attractive appearance.

SUMMARY OF THE INVENTION

The present invention provides a knee/elbow cap which comprises a cushion pad, a sponge pad, an unwoven cloth laver, and a pair of elastic bands. The cushion pad has a curved upper layer, a curved lower layer, and a plurality of rib plates, and is integrally made of injected plastics. The lower layer of the cushion pad is adhered by the sponge layer and the unwoven cloth layer successively by means of heat pressing to form an integral cap body. Each of the two elastic bands is attached with a Velcro latch at an end and the other end thereof is fixed to one of both lateral sides of the cap body respectively. The rib plates extend downward from the upper layer to the lower layer and cross and connect with one another to divide a space between the upper layer and the lower layer into a plurality of small rooms. The rib plates offer a high strength and strong shock absorption. A decoration piece of well-designed unique pattern can be embedded in one of the small rooms optionally to make the appearance of the cap body attractive.

An object of the present invention is to provide a knee/elbow cap having a plurality of rib plates crossing and connecting with one another therein so that a high strength and strong shock absorption against collisions can be achieved.

Another object of the present invention is to provide a knee/elbow cap which has a plurality of rooms formed by the rib plates and a decoration piece of well-designed unique pattern can be embedded in one of the rooms optionally to enhance a sense of beauty for the cap.

BRIEF DESCRIPTION OF THE DRAWINGS

The present invention can be more fully understood by reference to the following description and accompanying drawings.

DETAILED DESCRIPTION OF THE PREFERRED EMBODIMENTS

Figure 1:
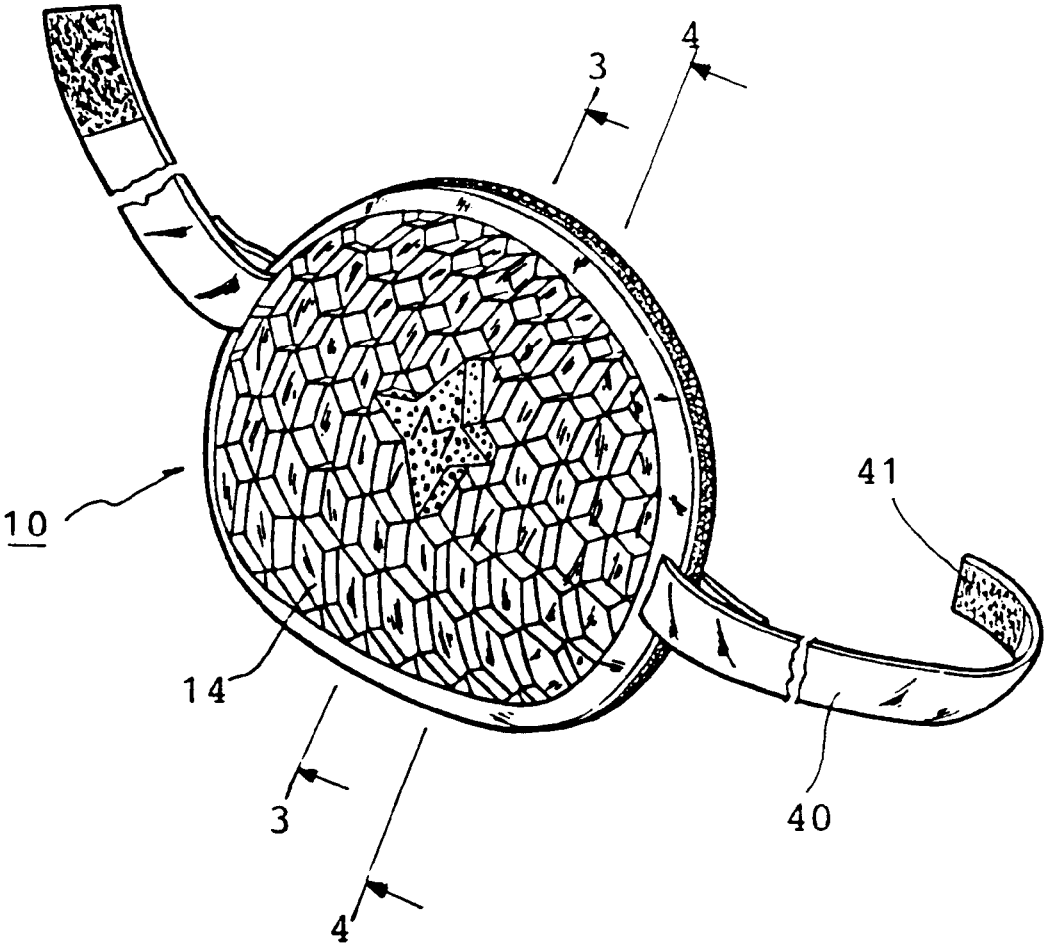
FIG. 1 is a perspective view of a knee/elbow cap of the present invention.
Figure 2:
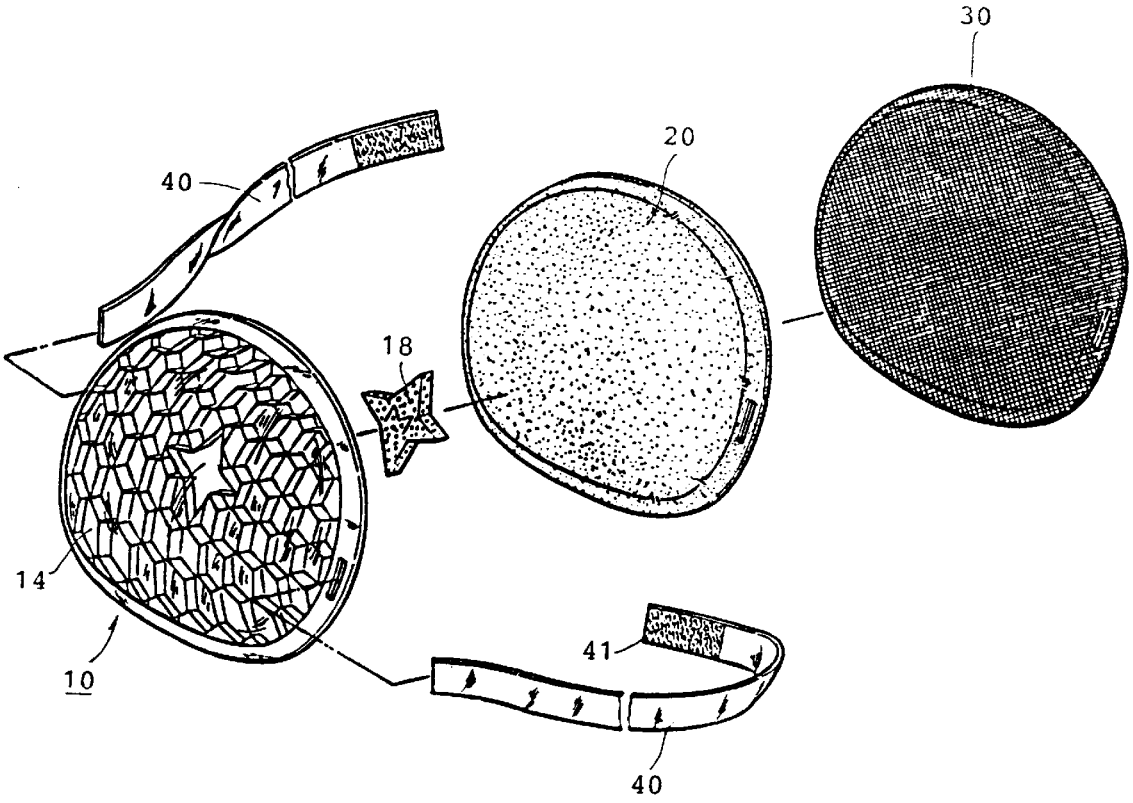
FIG. 2 is an exploded perspective view of the knee/elbow cap of the present invention.
Figure 3:
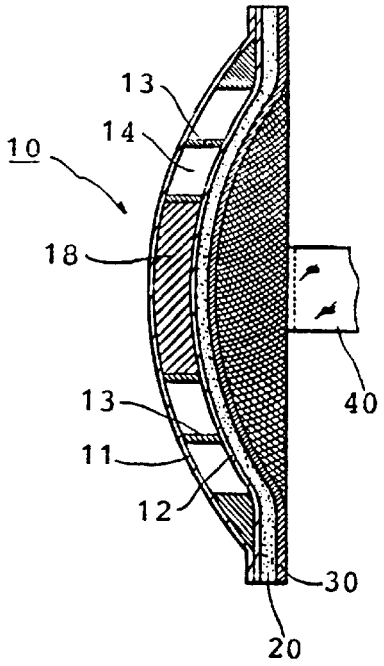
FIG. 3 is a sectional view along line 3—3 shown in FIG. 1.
Figure 4:
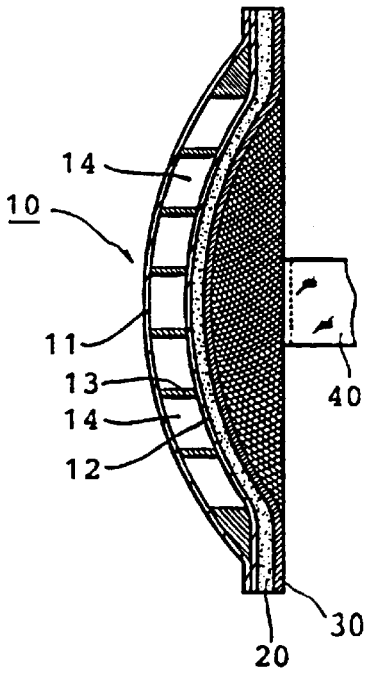
FIG. 4 is a sectional view along line 4—4 shown in FIG. 1.
Figure 5:
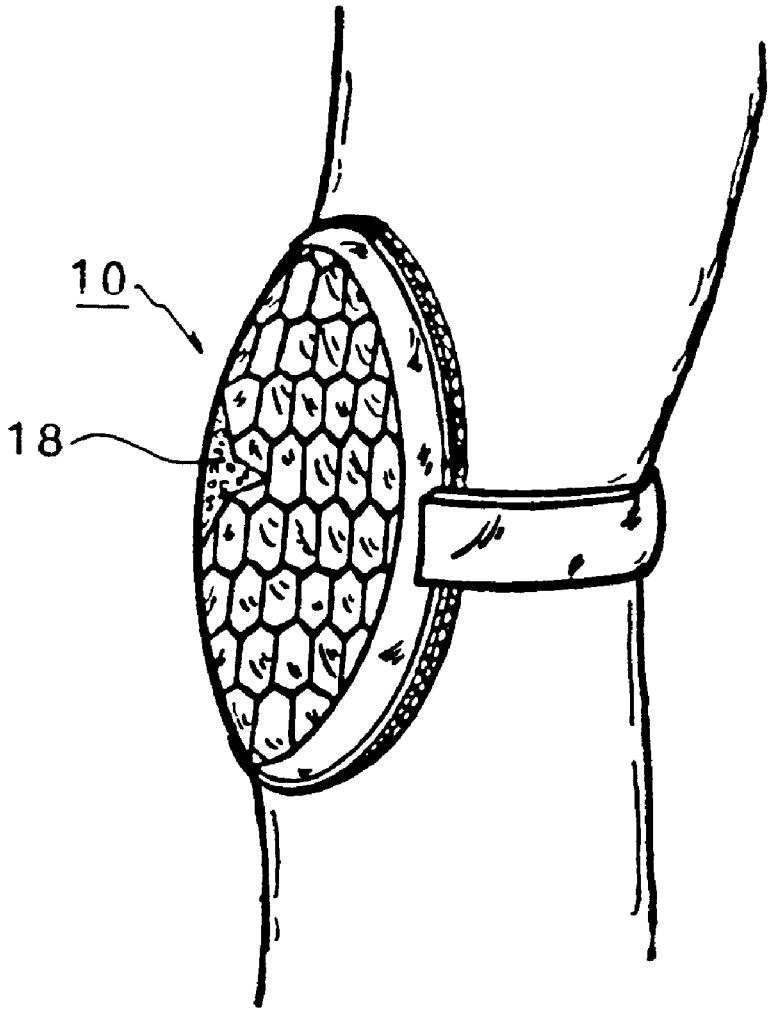
FIG. 5 is a schematic illustration of the knee/elbow cap of the present invention while in use.

Referring to FIG. 1, FIG. 2, FIG. 3, FIG. 4, and FIG. 5, a knee/elbow cap of the present invention comprises a cushion pad 10, a sponge pad 20, and an unwoven layer 30 and a pair of elastic bands 40. The cushion pad 10 is integrally made of injected plastics and consists of a curved upper layer 11, a curved lower layer 12, and a plurality of rib plates 13. The curved upper layer 11 has a grid like shape. The rib plates 13 extend from the upper layer 10 to the lower layer 12 in a form of crossing and connecting with one another and divide a space between the upper layer 10 and the lower layer 12 into a plurality of small rooms 14. The sponge pad 20 is adhered to the lower layer 12 and the unwoven layer 30 is adhered to the sponge pad 20 successively with heat pressing to constitute a cap body. Each of the two elastic bands is provided with a Velcro latch 41 at an end and the other end thereof is fixed to each lateral side of the cap body respectively. The rib plates 13 integrated with the upper layer 11 and the lower layer 12 can offer a high strength and strong shock absorption against collisions. A decoration piece 18 having a well-designed unique pattern can be embedded in one of the small rooms as desired to enhance attraction of the knee/elbow cap. The upper layer 11 can be kept transparent so that the rib plates 13 and the lower layer 12 can be seen clearly from outside. Therefore, if specific figures are printed on the lower layer 12, a much more attractive knee/elbow cap can be obtained. The elastic bands 40 can be used to detachably fasten the cap to a knee/elbow with the Velcro latch 41.

In addition, the grid like structure formed in the cushion pad 10 can be fitted in other safety facility such as helmet, wrist cap, chest guard, and etc. as desired to reinforce a specific spot which anti-collision is needed.

While the invention has been described with reference to preferred embodiments thereof, it is to be understood that modifications or variations may be easily made without departing from the spirit of this invention which is defined by the appended claims.

I claim:

1. A knee/elbow cap, comprising:

a cushion pad integrally made of injected plastics and having an curved upper layer, a curved lower layer, and a plurality of rib plates;

a sponge layer adhering to said lower layer;

an unwoven cloth layer adhering to said sponge layer; and two elastic bands fixing to said cap, each of said two bands having a Velcro latch at an end; wherein said plurality of rib plates extend from the upper layer to the lower layer in a form of crossing and connecting with one another and divide a space between the upper layer and the lower layer into a plurality of small rooms to make the cushion pad have a grid like structure.

2. A knee/elbow cap according to claim 1, wherein a decoration piece with well-designed pattern can be embedded in one of said plurality of small rooms optionally.

3. A knee/elbow cap according to claim 1, wherein said grid like structure of the cushion pad can be installed in other sport caps.

4. A knee/elbow cap according to claim 1, wherein figures can be printed on the lower layer of said cushion pad.

* * * * *